US005915976A

United States Patent [19]

McHugh

[11] Patent Number: 5,915,976

[45] Date of Patent: Jun. 29, 1999

[54] HIGH SPEED CONNECTOR

[75] Inventor: Robert G McHugh, Evergreen, Colo.

[73] Assignee: Hon Hai Precision Ind. Co., Ltd., Taipei Hsien, Taiwan

[21] Appl. No.: 08/795,753

[22] Filed: Feb. 6, 1997

[51] Int. Cl.[6] ..... H01R 9/09

[52] U.S. Cl. ..... 439/74; 439/660; 439/108

[58] Field of Search ..... 439/74, 660, 108

[56] References Cited

U.S. PATENT DOCUMENTS

| | | | |
|---|---|---|---|
| 5,181,855 | 1/1993 | Mosquera et al. | 439/74 |
| 5,429,520 | 7/1995 | Morlion et al. | 439/108 |
| 5,433,617 | 7/1995 | Morlion et al. | 439/108 |
| 5,476,622 | 12/1995 | Consoli et al. | 439/181 |
| 5,626,482 | 5/1997 | Chan et al. | 439/74 |
| 5,697,799 | 12/1997 | Consoli et al. | 439/181 |

*Primary Examiner*—Neil Abrams
*Assistant Examiner*—T. C. Patel

[57] ABSTRACT

A board-to-board connector assembly (10) includes a plug connector (12) and a receptacle connector (14), each of which includes an insulative housing (16, 60) and a plurality of contacts (26, 64) therein. A pair of grounding shields or grounding plates (39) are positioned on two sides of the housing (16) of the plug connector (12) wherein a plurality of grounding pins (44) of each grounding plates (39) are selectively connected to some of the contacts (26) of the plug connector (12), and a corresponding number of engagement arms (42) are positioned opposite to such grounding pins (44), respectively. Correspondingly, a corresponding number of grounding contacts (72) are disposed in the housing (64) of the receptacle connector (14) wherein an outer portion or the engagement section (77) of each grounding contact (72) engages the corresponding engagement arm (42) of the grounding plate (39), and an inner portion or the abutment section (78) thereof engages the corresponding contact of the receptacle connector (14). Thus, EMI or the undesired noises can be eliminated from such selected contacts (26, 64) and grounding pins (44) and grounding contacts (72) through the plates (39).

19 Claims, 10 Drawing Sheets

HIGH SPEED CONNECTOR

BACKGROUND OF THE INVENTION

1. Field of The Invention

The invention relates to electrical board-to-board connectors, and particularly to the high speed connector assembly including a pair of plug and receptacle connectors mated with each other wherein grounding plates and grounding contacts are provided therewith for filtering noises and EMI (electromagnetic interference).

2. The Related Art

Board-to-board connector assembly generally includes a pair of plug and receptacle connectors respectively mounted on two parallel spaced PC boards and adapted to mate with each other for mechanical and electrical interconnection therebetween, whereby the corresponding PC boards can be electrically connected with each other for signal transmission. The conventional board-to-board connector assembly can be referred to U.S. Pat. Nos. 5,310,357, 5, 395,250 and 5,478,248. Anyhow, the traditional board-to-board connector assembly generally only meets the requirements of the low frequency or speed transmission wherein the noises and EMI are not so critical to signal transmission that there are generally no specific shielding or grounding contacts provided therewith for removing such unexpected noises or interference therefrom. Recently, some modified board-to-board connector assemblies are introduced to the market wherein some of the signal pins, which functions as a grounding pins, further include integrally formed lateral sections for engagement with the shield of the connector for removal of EMI generated thereof. This attempt may acquire the purpose of removal of the undesired noises or EMI thereof, while the integrally formed laterally extending grounding section of the original signal contact requires that the whole contact piece be made by stamping which directly punches the designed shape of the contact piece including the laterally extending grounding section thereof from a metal plate. As well known, the directly one step stamping type contact piece generally lacks sufficient resiliency in comparison with the forming type one because the latter takes the further second processing step to bend the material in a direction of its thickness whereby the interior structure around the bending area becomes weak and relatively provides more resiliency thereabout. Thus, it is desired that the contacts of the connector assembly are provided in a form of forming while the grounding function is still provided therewith by other means.

Therefore, an object of the invention is to provide a board-to-board connector assembly comprising a plug connector and a receptacle connector wherein the grounding function is provided therewith through separate grounding pins of the receptacle connector incorporating the shield of the plug connector.

SUMMARY OF THE INVENTION

According to an aspect of the invention, a board-to-board connector assembly includes a plug connector and a receptacle connector, each of which includes an insulative housing and a plurality of contacts therein. A pair of grounding shields or grounding plates are positioned on two sides of the housing of the plug connector wherein a plurality of grounding pins of each grounding plates are selectively connected to some of the contacts of the plug connector, and a corresponding number of grounding sections are positioned opposite to such grounding pins, respectively. Correspondingly, a corresponding number of grounding contacts are disposed in the housing of the receptacle connector wherein an outer portion of each grounding contact engages the corresponding arm-like grounding section of the grounding plate, and an inner portion thereof engages the corresponding contact of the receptacle connector. Thus, EMI or the undesired noises can be eliminated from such selected contacts and grounding pins and grounding contacts through the plates.

DETAILED DESCRIPTION OF THE PREFERRED EMBODIMENTS

Figure 1:
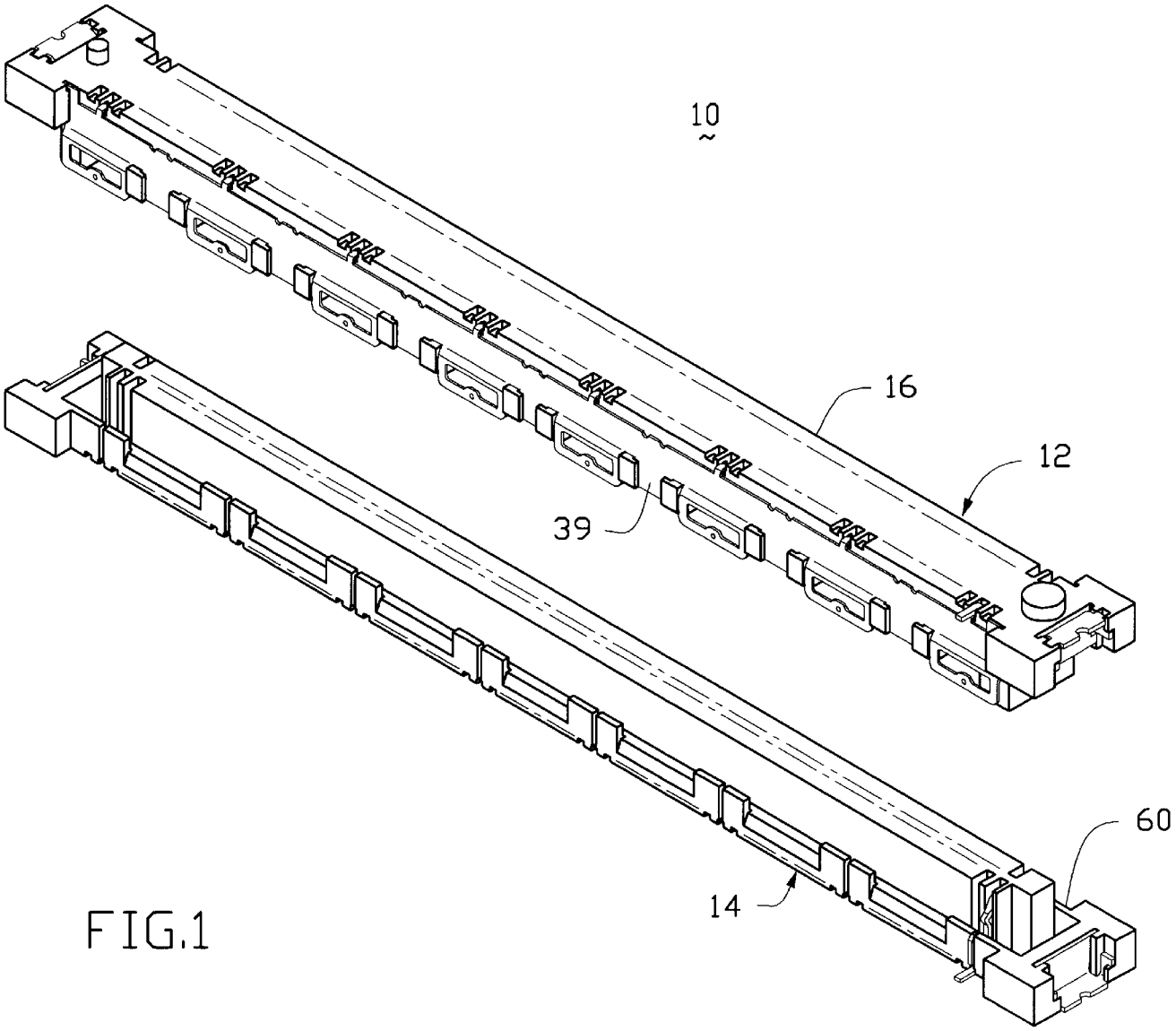
FIG. 1 is a perspective view of a presently preferred embodiment of a board-to-board connector assembly including a pair of separate plug connector and receptacle connector, according to the invention, wherein only few contacts are shown.
Figure 2:
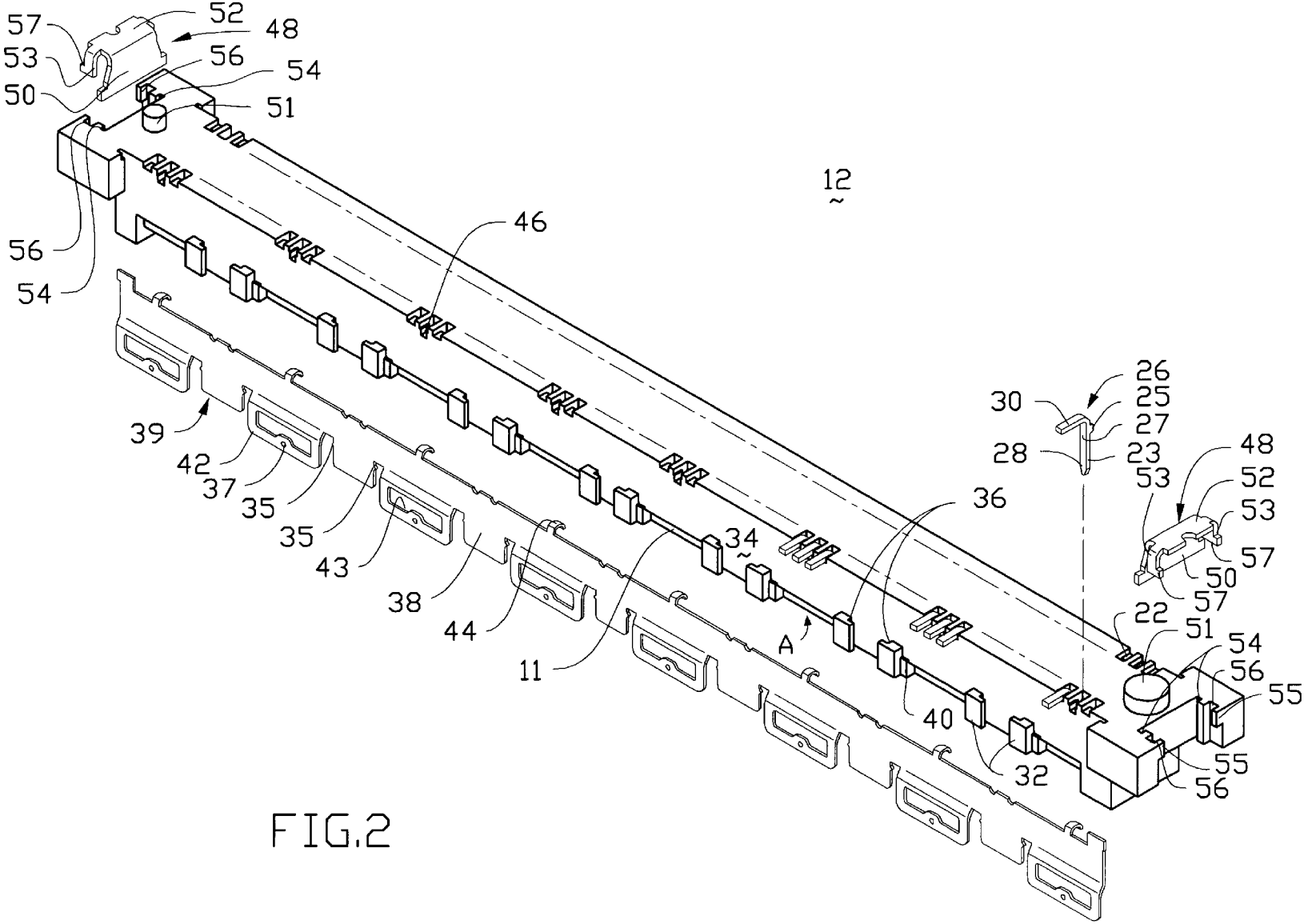
FIG. 2 is an exploded perspective view of the plug connector of FIG. 1 wherein only few contacts are shown.
Figure 3:
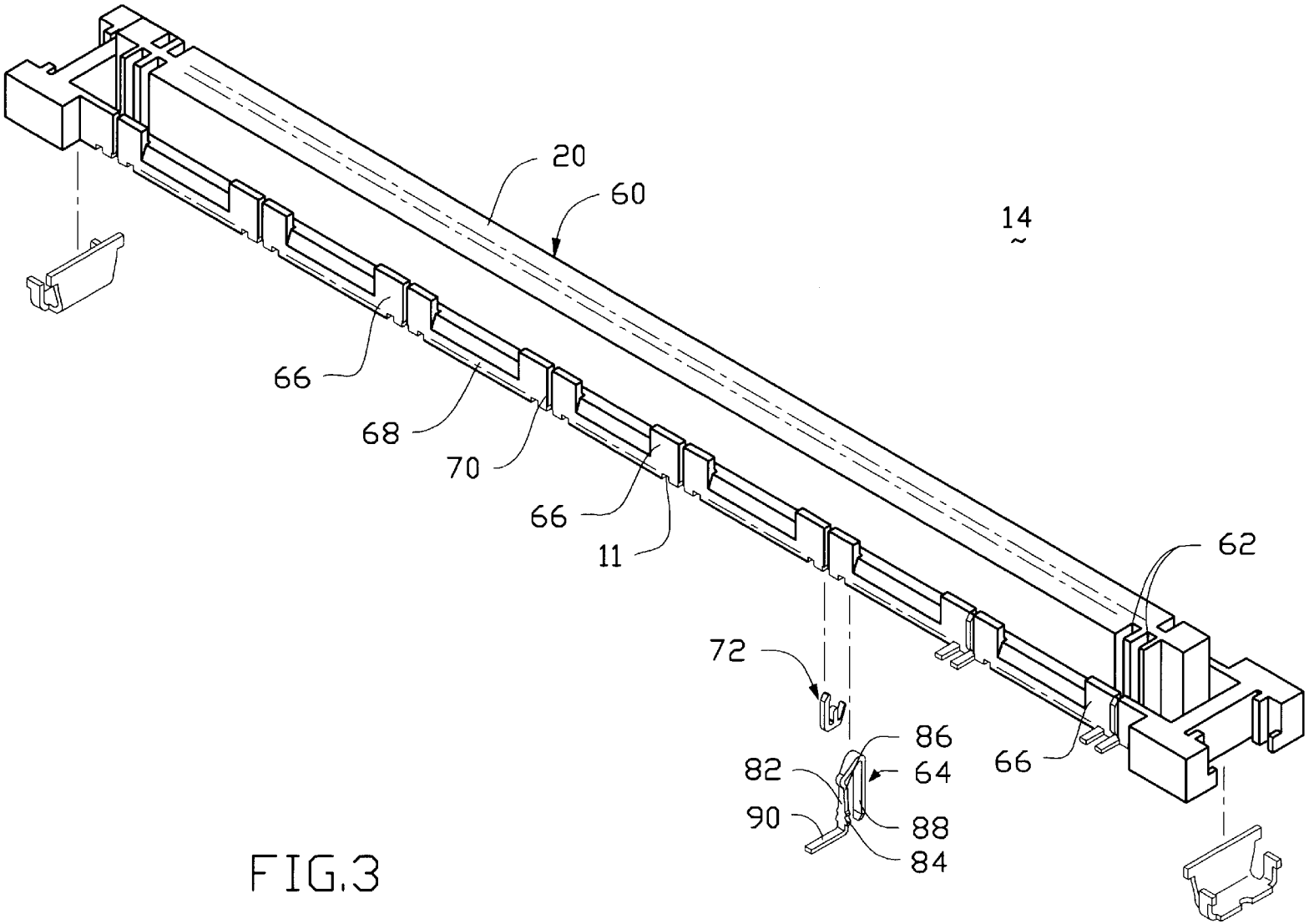
FIG. 3 is an exploded perspective view of the receptacle connector of FIG. 1 wherein only few contacts are shown.
Figure 4:
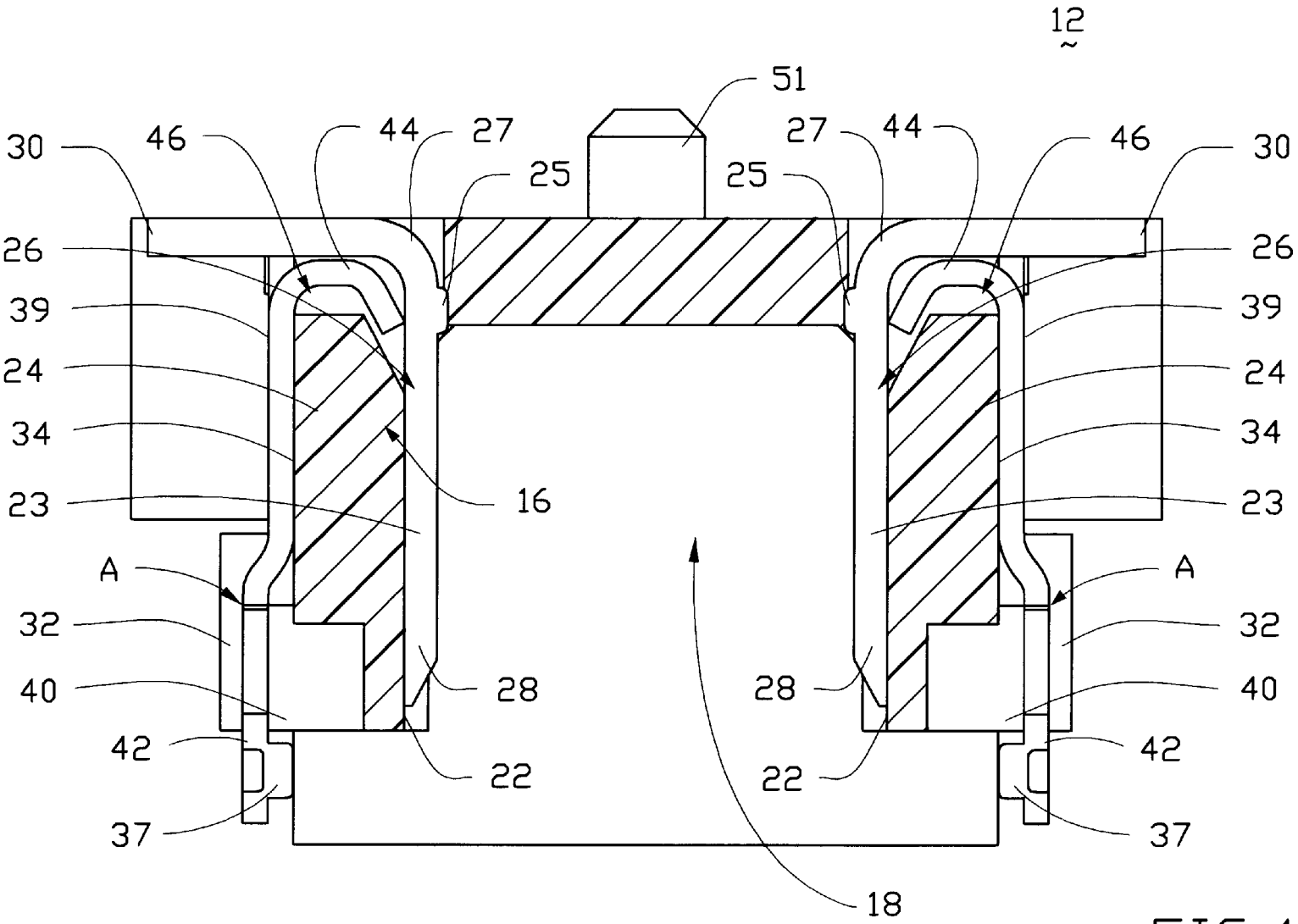
FIG. 4 is a cross-sectional view of the plug connector of FIG. 1.
Figure 5:
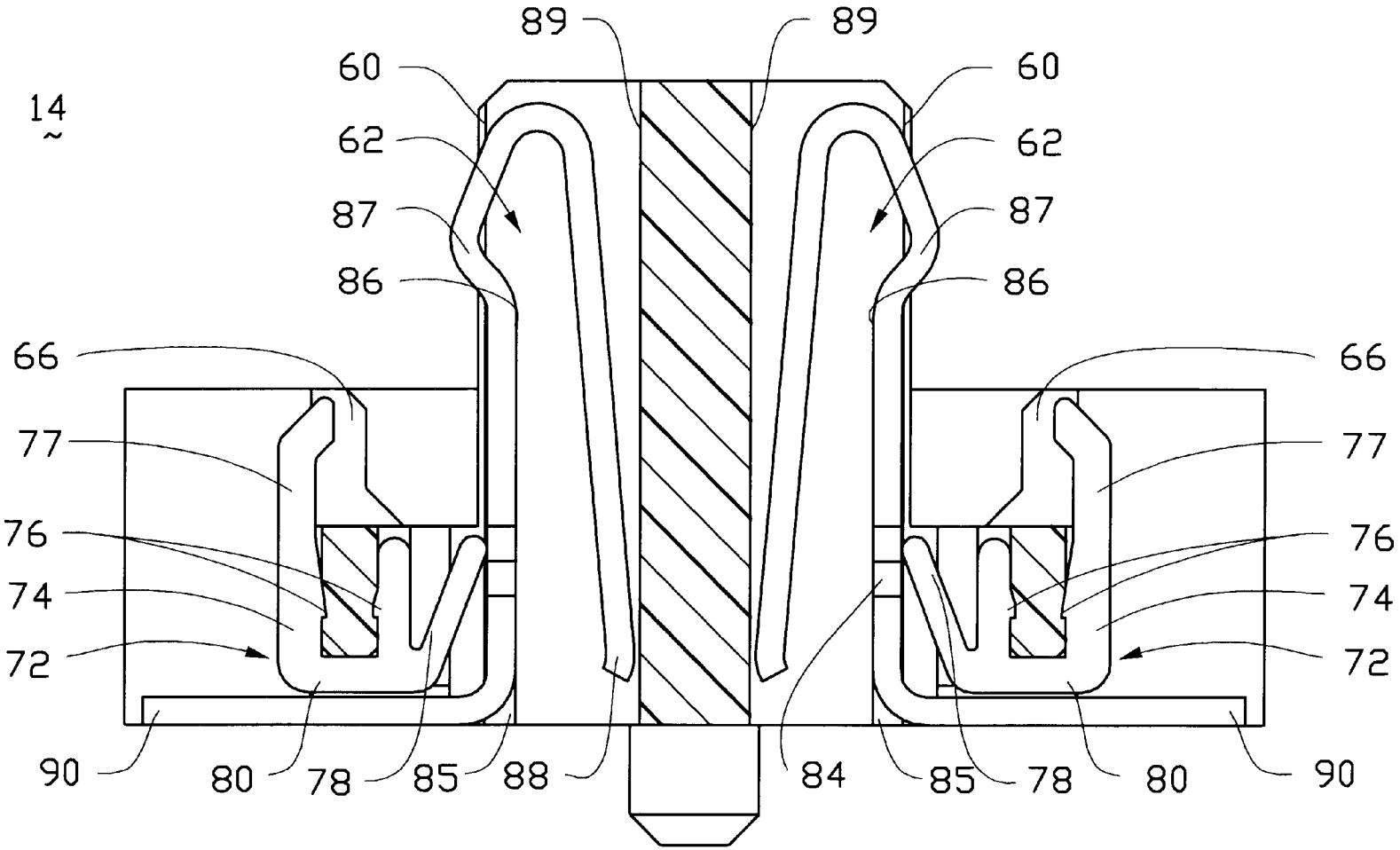
FIG. 5 is a cross-sectional view of the receptacle connector of FIG. 1.
Figure 6:
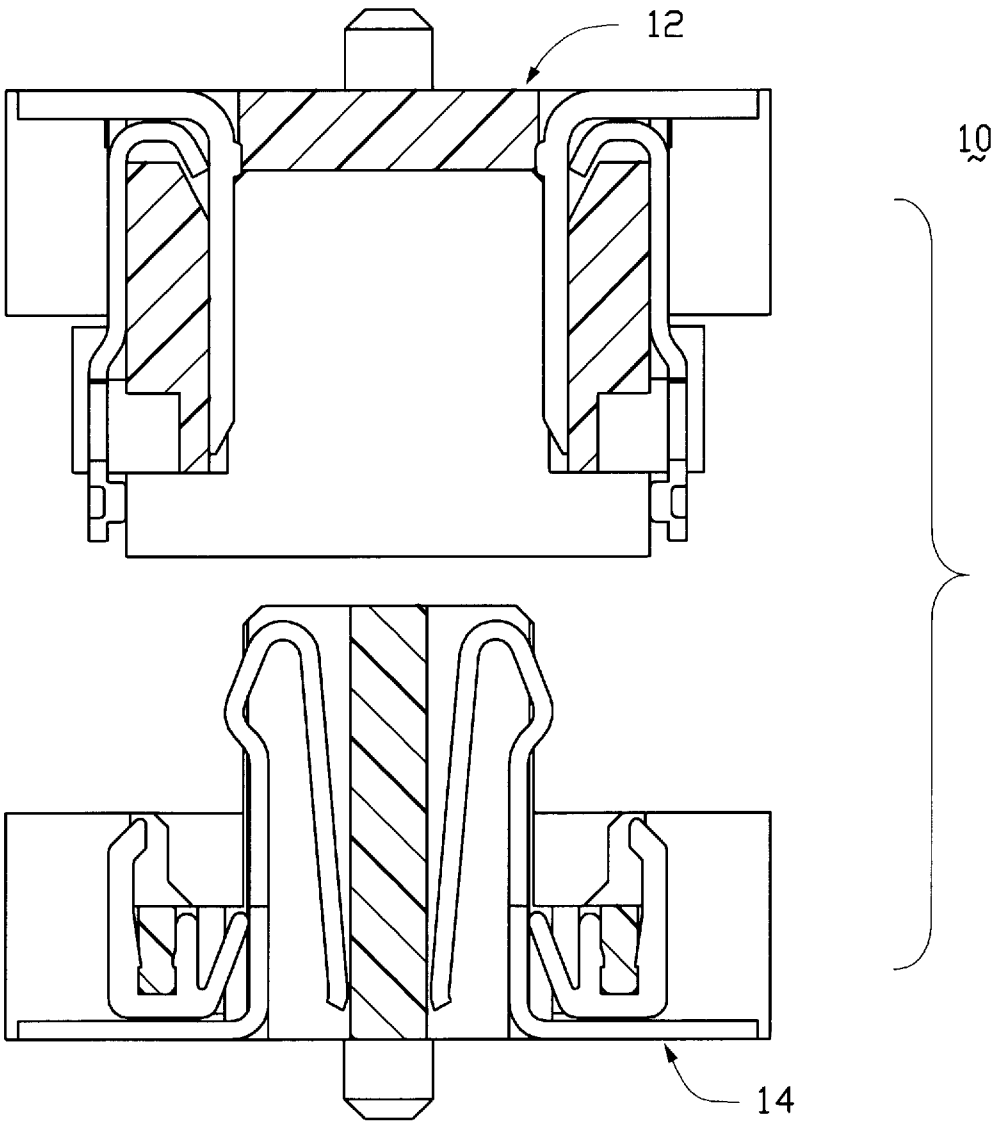
FIG. 6 is a cross-sectional view of the plug connector and the receptacle connector of FIG. 1 where are ready to mate with each other to show how the contacts, the grounding contacts and the grounding plate aligned with each other for mutual engagement.
Figure 7:
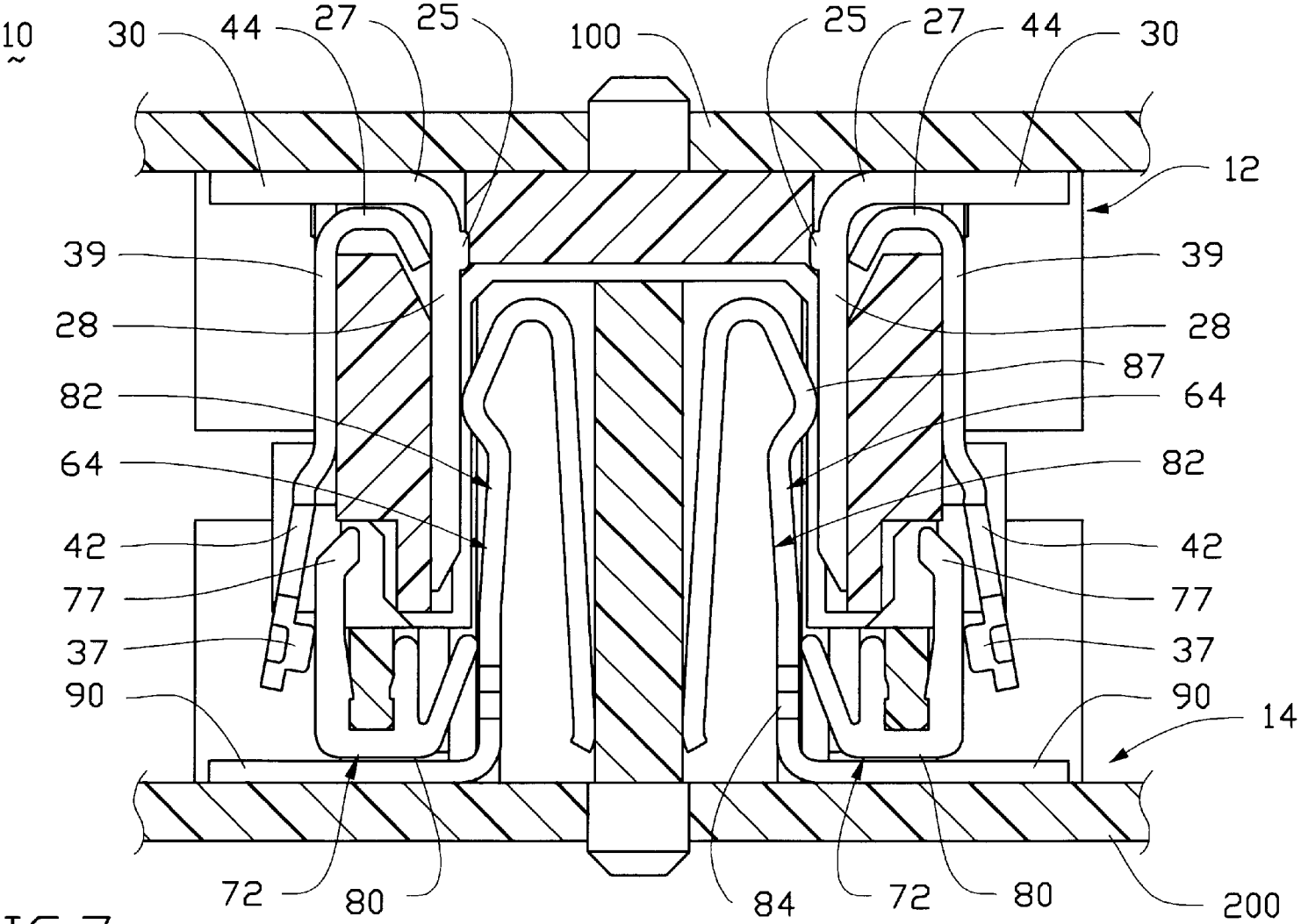
FIG. 7 is a cross-sectional view of the assembled plug and receptacle connectors to show the engagement between the grounding contacts of the receptacle connector and the grounding plate of the plug connector.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–7 wherein a board-to-board connector assembly 10 includes a pair of (first) plug connector 12 and (second) receptacle connector 14 adapted to mate with each other.

The plug connector 12 includes a first insulative housing 16 defining a central cavity 18 for receiving a central island 20 of the receptacle connector 14 therein which will be described in detail later. A plurality of first passageway 22 are side by side disposed along two side walls 24 of the first housing 16 of the plug connector 12 for receiving a corresponding number of first contacts 26 therein. Each first contact 26 includes a main body 23 with an engagement section 28 and a tail section 30 wherein the engagement section 28 faces to the cavity 18 and the tail section 30 solderably mounted to the PC board 100 on which the plug connector 12 is seated.

The housing 16 includes a number of pairs of protrusions 32 are positioned on an exterior surface 34 of each side wall 24 at equal intervals. Each pair of protrusions 32 respectively define a pair of channels 36 facing to each other for receiving therein a corresponding retention arm 38 of a grounding/shielding plate 39. Furthermore, a space A is formed between the adjacent two opposite protrusions 32 of the adjacent two different pairs of protrusions 32 wherein a standoff 40 is formed on the exterior surface of each of such adjacent two opposite protrusions 32 so that the space A can supportably receive a corresponding hollow type engagement arm 42 defining a central opening 43 of the grounding plate 39 wherein the engagement arm includes a contacting kink 37 on the middle portion. It can be seen that in this embodiment, the total number of the engagement arms is eight.

Accordingly, the grounding plate 39 can be attached to the exterior surface 34 of each side wall 24 wherein each retention plate 38 can be interferentially engaged within the corresponding pair of channels 36 by means of barbs 35 formed on two sides thereof, and each engagement arm 42 can supportably abut against the corresponding pair of standoffs 40 and be received within the corresponding space A. Provided opposite to each engagement arm 42 is a grounding pin 44 which is generally received within a recessed slot 46 in the housing 16 wherein such recessed slot 46 is communicatively aligned with the corresponding passageway 22. Therefore, each grounding pin 44 of the grounding plate 39 substantially mechanically and electrically engages the main body 23 of the corresponding contact 26 for grounding consideration.

The contact 26 includes a main body 23 with a pair of barb sections 27 on two sides of the engagement section 28 for interferentially retaining the contact 26 in the passageway 22, and an embossment 25 protruding laterally with regard to the barb sections 27 for abutment with the inner surface of the passageway 22 so as to stabilize the contact 26 in the passageway 22.

A pair of mounting ears 48 are disposed at two opposite ends of the housing 16 wherein each mounting ear 48 includes a vertical portion 50, a horizontal portion 52 and a pair of locking portions 53 vertically extending from two opposite ends of the horizontal portion 52. Corresponding to each mounting ear 48, the housing 16 includes a first pair of slots 54 for interferential engagement with the expansion sections 56 of the vertical portion 50 of the metal ear 48, and a second pair of slots 56 for receiving the locking portions 53 wherein the housing 16 further includes a pair of engagement blocks 55 for engagement with the engaging tabs 57 extending from the locking portions 53 of the mounting ear 48.

A pair of different size posts 51 extend downward from the housing 16 of the connector 12 for reception within a pair of corresponding different size holes in the PC board 100.

The receptacle connector 14 includes a second insulative housing 60 defining a central island 20 wherein a plurality of second passageways 62 are side by side disposed along the housing 14 for receiving a corresponding number of second contacts 64 therein. A plurality of vertical walls 66, the number of which is equal to that of the engagement arms 42, are positioned along each of the side walls 68 wherein the distance between every adjacent two vertical walls 66 are generally equal to that between every adjacent two engagement arms 42 of the plug connector 12. It is noted that to receive the corresponding vertical walls 66, the plug connector 12 includes a plurality of recessions 11 in each of the side walls 24.

A slot portion 70 is formed within a middle portion of each of the vertical walls 66 for receiving a corresponding grounding contact 72 therein. The grounding contact 72 includes a main body 74 with barbs 76 for interferential engagement within the slot portion 70, an engagement section 77 of the main body 74, an abutment section 78 extending upward and obliquely, and a tail 80 extending horizontally.

The contact 64 includes a main body 82 with barb sections 84 on two sides for interferential engagement within a pair of small channels 85 beside the corresponding passageway 62 in the housing 60. A bellow type engagement section 86 upward extending from the main body 82 wherein an engagement apex 87 protrudes out of the corresponding passageway 62 for engagement with the engagement section 28 of the corresponding first contact 26, and a butting section 88 is disposed at the distal end thereof for abutment with the interior surface 89 in the passageway 62 of the housing 60. The contact 64 further includes a tail section 90 downward and successively outwardly extending from the main body 82 for solderably mounting to a PC board 200 on which the receptacle connector 14 is seated.

It can be seen that the tail 80 of each grounding contact 72 can be engaged with the tail section 90 of the corresponding contact 64 for grounding consideration. Also, the abutment section 78 of the grounding contact 72 may contact the engagement section 86 of the contact 64.

When the plug connector 12 and the receptacle connector 14 are mutually mated with each other, the island 20 of the receptacle connector 14 is received within the cavity 18 of the plug connector 12 whereby the engagement apex 87 of each second contact 64 of the receptacle connector 14 is inwardly deflectably engaged with the corresponding engagement section 28 of the first contact 26 of the plug connector 12, and the engagement section 77 of the main body 74 of each grounding contact 72 of the receptacle connector 14 is forcibly engaged with the contacting kink 37 of the corresponding engagement arm 42 of the grounding plate 39 of the plug connector 12. Therefore, a fully mutual grounding is achieved between the PC board 100 /or the plug connector 12 and the PC board 200 /or the receptacle connector 14 through the cooperation of some corresponding specific first contacts 26, the grounding pins 44, the grounding plate 39, the engagement arms 42, the engagement sections 77 and the tails 80 and/or the engagement sections 77 of the grounding contacts 72, and the tail sections 90 and/or the engagement sections 86 of some corresponding specific second contacts 64. The prompt and short grounding path eliminates EMI in the mated connector assembly.

In this embodiment, a reinforcement block (not shown) can be inserted into each of the second passageways 62 engage the main body 82 of the contact 64 for supportably reinforcing the fixation of the contact 64 in the second passageway 62.

It is also understood that the hollow type engagement arm 42 cooperates with a pair of standoffs 40 of the corresponding pair of protrusions, thus providing a better resilient engagement between the kink 37 of the engagement arm 42 and the corresponding grounding contact 72.

Figure 8:
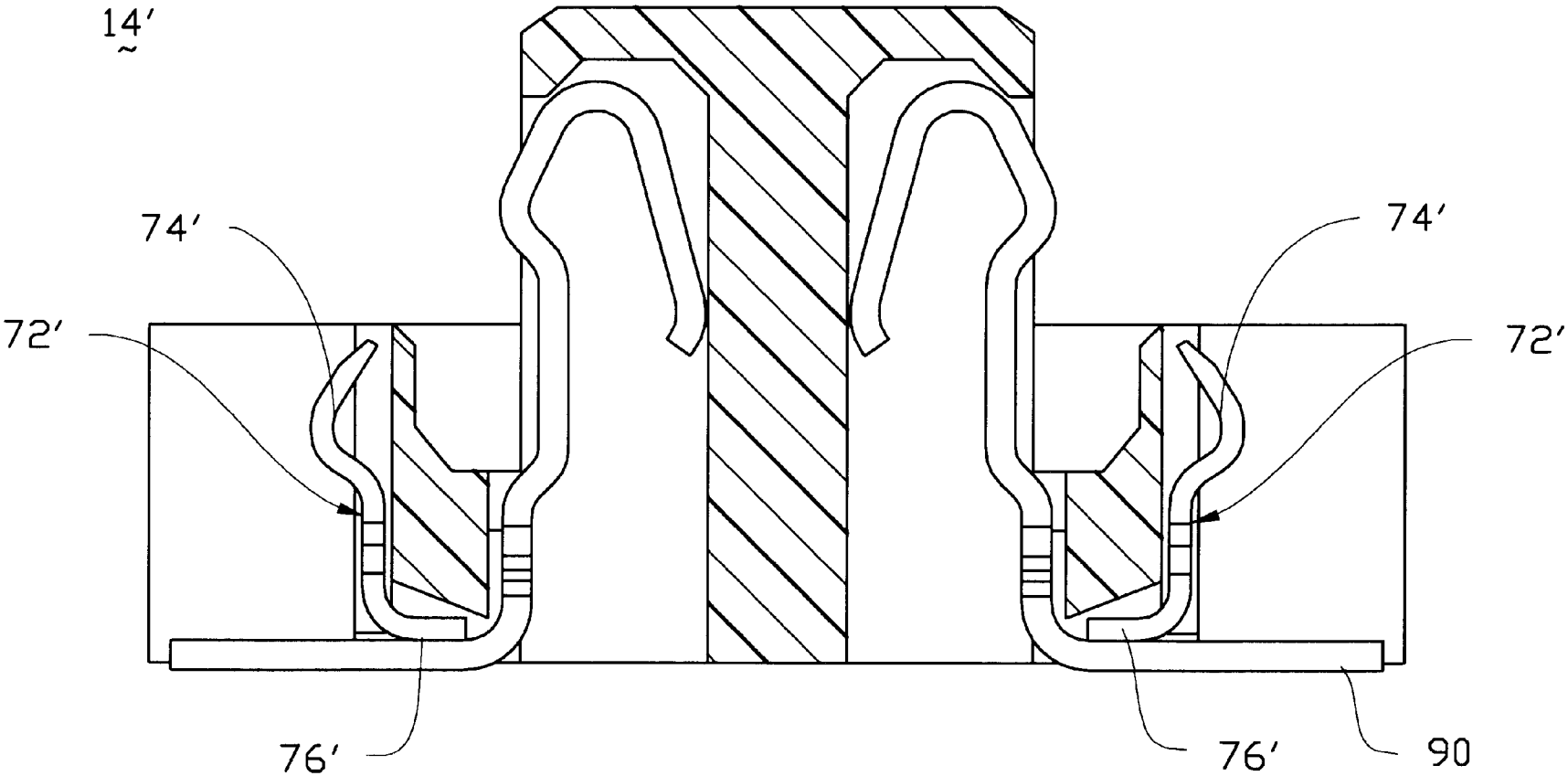
FIG. 8 is a cross-sectional view of a receptacle connector of a second embodiment to show another type grounding contact.
Figure 9:
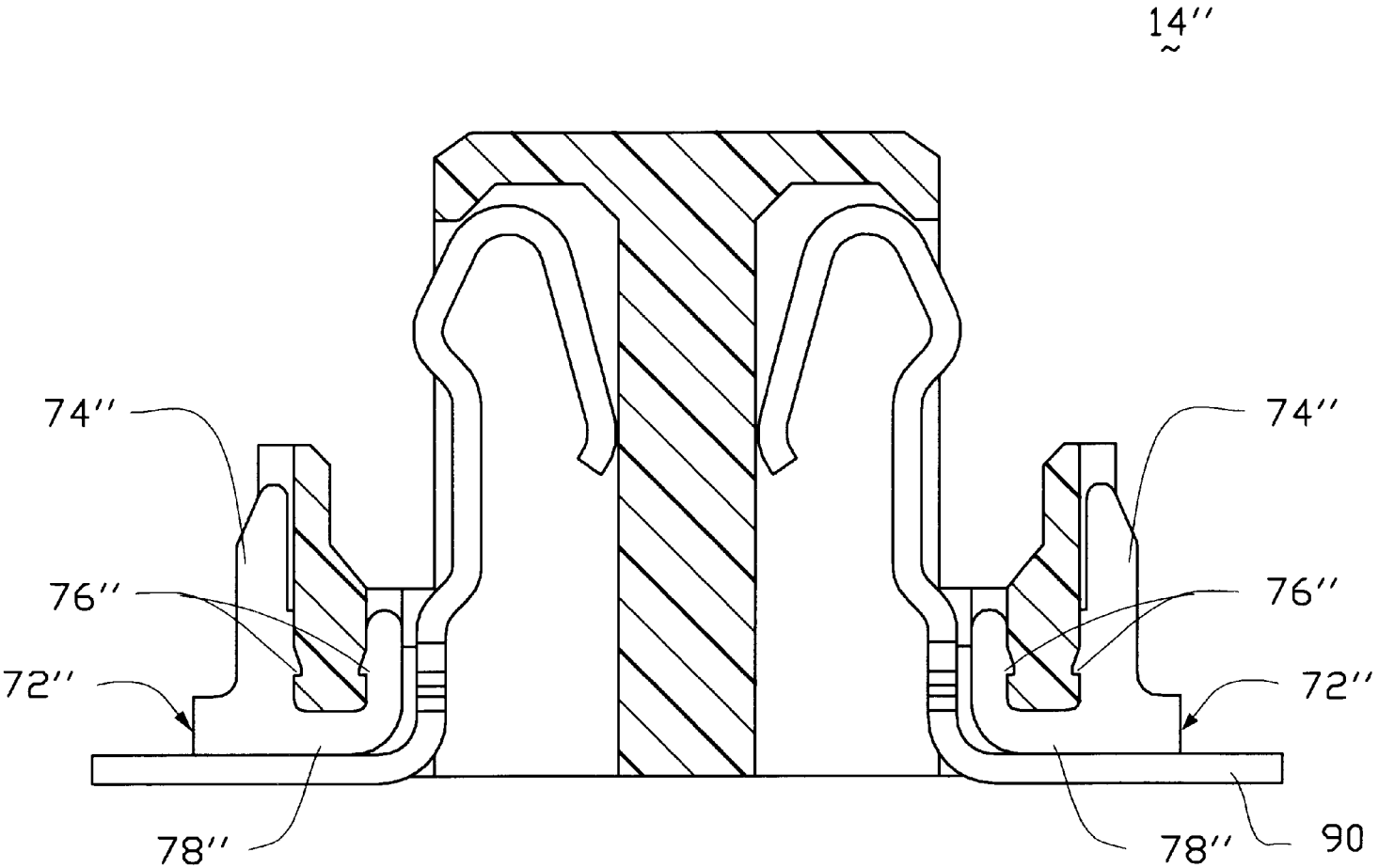
FIG. 9 is a cross-sectional view of a receptacle connector of a third embodiment to show another type grounding contact.
Figure 10:
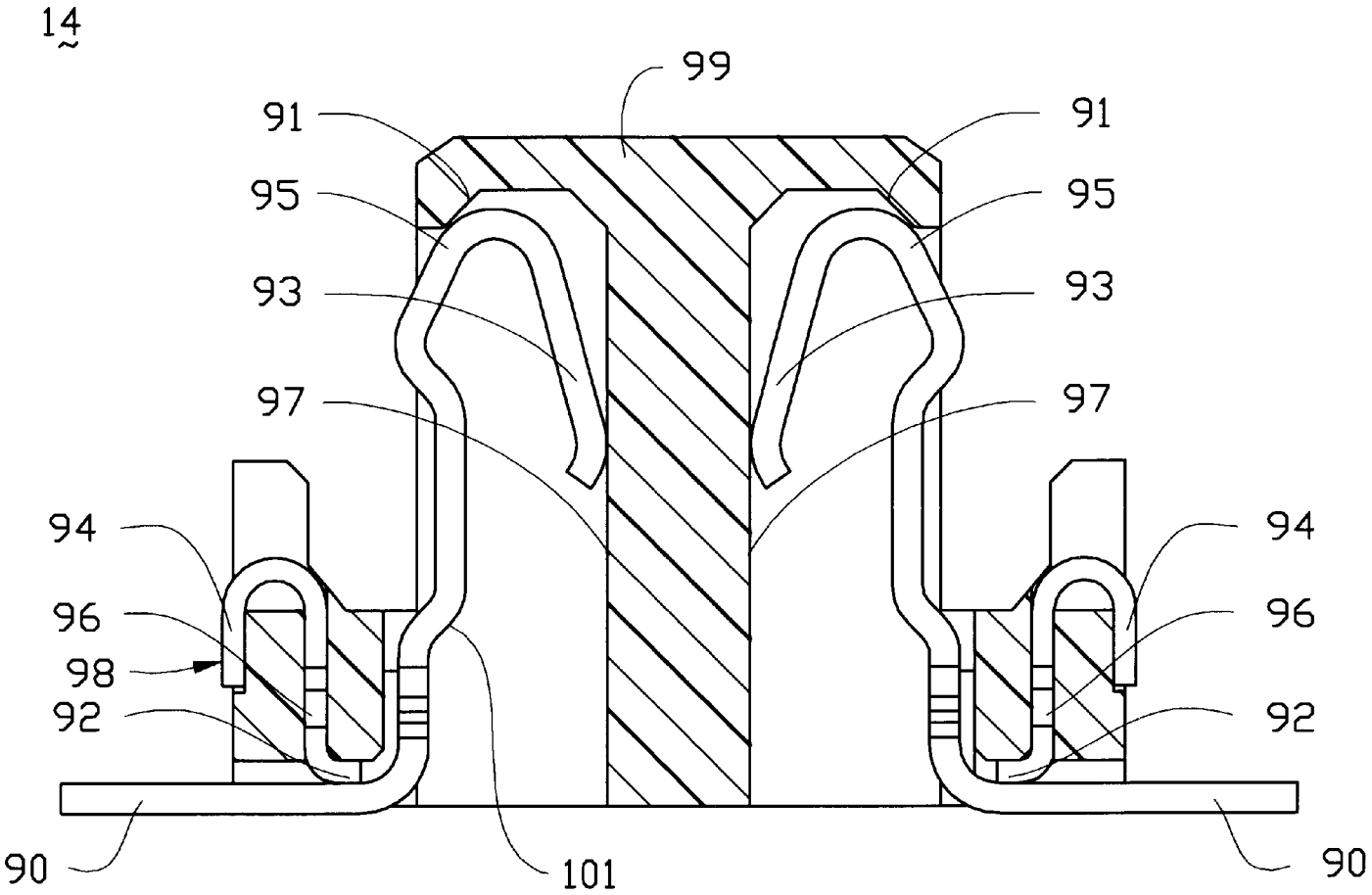
FIG. 10 is a cross-sectional view of a receptacle connector of a fourth embodiment to show another type grounding contact.

FIG. 8 shows another embodiment of the invention wherein the grounding contact 72' has an engagement section 74' and a tail 76'. FIG. 9 shows another embodiment of the invention wherein the grounding contact 72" includes an engagement section 74", a tail section 78" and a pair of barbs 76". FIG. 10 shows another embodiment wherein the receptacle connector 14 includes an abutment block 91 on the corner to engage the engagement section 95. The engagement section further includes a distal end 93 to engage the inner surface 97 of the housing 99 of the connector 14. Oppositely, the grounding contact 98 includes an engagement section 94, a tail 92 and barbs 96 wherein the tail 92 can engage the tail section 90 of the contact 89.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A board-to-board connector assembly comprising:

a plug connector including a first insulative housing defining a central cavity with a plurality of first passageways disposed in side walls of the first housing;

a plurality of first contacts each received in one of said first passageways;

at least one unitary grounding plate generally positioned on an exterior surface of one of said side walls of the first housing, said at least one grounding plate each including a plurality of grounding regions respectively engagably aligned with some of said first contacts;

a receptacle connector including a second insulative housing defining a central island for reception within the central cavity of the plug connector;

a plurality of second passageways disposed in side walls of the second housing;

a plurality of second contacts each received in one of said second passageways;

a plurality of grounding contacts positioned in at least one side wall of the second housing engagably aligned with some of said second contacts of the receptacle connector and also corresponding to the grounding regions of the unitary grounding plate of the plug connector.

2. The assembly as defined in claim 1, wherein the grounding plate further includes a plurality of engagement arms corresponding to and opposite to the grounding regions, respectively, thereby to directly abut against the corresponding grounding contacts of the receptacle connector, respectively.

3. The assembly as defined in claim 2, wherein the first housing further includes a plurality of pairs of protrusions formed on the exterior of one of said side walls whereby each of said engagement arms of the grounding plate of the plug connector can be received within a space defined between one protrusion of one pair and another opposite nearest protrusion of the adjacent pair.

4. The assembly as defined in claim 3, wherein the grounding plate further includes a plurality of retention arms are formed therealong and each between every two adjacent engagement arms for interferential reception within the corresponding pair of protrusions.

5. The assembly as defined in claim 3, wherein the engagement arm defines a central opening, and a pair of standoffs are provided within the space so as to achieve a better resilient engagement between the engagement arm and corresponding grounding contact.

6. The assembly as defined in claim 3, wherein the second housing of the receptacle connector further includes a plurality of vertical walls extending upward from thereof at least one side wall corresponding to the engagement arms of the plug connector, and the first housing of the plug connector further includes a plurality of corresponding recessions for receiving said vertical walls therein.

7. The assembly as defined in claim 1, wherein the first contact of the plug connector includes a main body having sections on two sides, an engagement section and a tail section whereby the corresponding grounding region of the grounding plate abuts against the main body of the contact.

8. The assembly as defined in claim 1, wherein the second contact includes a main body with barb sections, from which an engagement section upward extends and a tail section horizontally and outwardly extends, and wherein an engagement apex of the engagement section protrudes out of an exterior surface of the central island, and a distal end of the engagement section butts an interior surface of the second housing in the corresponding second passageway.

9. The assembly as defined in claim 8, wherein the grounding contact includes a main body with, an engagement section extending upward therefrom for engagement with a corresponding engagement arm of the grounding plate, and a tail horizontally extending therefrom for engagement with tail section of the second contact.

10. The assembly as defined in claim 8, wherein the grounding contact includes a pair of retention posts for fastening the grounding contact, and a contacting tang, and wherein the contacting tang engages the main body of the second contact and an outermost retention post engages a corresponding engagement arm of the grounding plate of the plug connector.

11. The assembly as defined in claim 1, wherein at least one of the plug connector and the receptacle connector further includes a mounting ear electrically isolated from the grounding plate, including a vertical portion, a horizontal portion and a pair of locking portions extending from two opposite ends of the horizontal portion.

12. The assembly as defined in claim 11, wherein one of the first housing and the second housing further includes a first pair of slots for interferentially receiving the vertical portion, and a second pair of slots for receiving the locking portions, and wherein a pair of engagement blocks are provided with the housing for engagement with a pair of engaging tabs extending from the locking portions of the mounting ear.

13. A plug connector comprising:

an insulative housing defining a central cavity and side walls;

a plurality of contacts disposed in at least one of said side walls;

a unitary grounding plate positioned on an exterior surface of one of said at least one side wall and including a plurality of grounding regions adapted to engage some of the contacts;

a plurality of engagement arms disposed on said unitary grounding plate and extending opposite to the corresponding grounding regions; and a plurality of protrusions positioned on an exterior surface of said one side wall.

14. The plug connector as defined in claim 13, wherein each of the engagement arms can be received within a space defined between every two adjacent protrusions.

15. The plug connector as defined in claim 13, wherein the grounding plate further includes a plurality of retention arms each positioned between every two adjacent engagement arms.

16. A receptacle connector comprising:

an insulative housing defining a plurality of spaced vertical outer walls aligned in longitudinally lateral sides thereof and a central island having lateral side walls;

a plurality of contacts disposed in at least one of said side walls of the central island; and a plurality of grounding contacts positioned in at least one of said vertical out walls and adapted to engage some of the contacts; wherein each grounding contacts includes a main body from which an engagement section protrudes out of an exterior surface of the corresponding side wall, and a tail extends horizontally for engagement with the corresponding contacts.

17. A connector assembly including two mated connectors, comprising:

a first connector including a first housing with a plurality of first contacts received therein and a unitary grounding plate having more than one grounding regions thereof for mechanical and electrical engagement with some of the first contacts;

a second connector including a second housing with a plurality of second contacts received therein and a plurality of grounding contacts; wherein the grounding contacts electrically and mechanically engage some of the second contacts, respectively, and are substantially aligned with the corresponding grounding regions, respectively.

18. The connector assembly as defined in claim 17, wherein the grounding plate further includes a plurality of engagement arms in alignment with the corresponding grounding regions, respectively, for direct engagement with the corresponding grounding contacts, respectively.

19. A connector assembly including two connectors, said connector assembly comprising:

a first connector including a first housing with a plurality of first contacts therein;

a second connector including a second housing with a plurality second contacts therein; and at least a mounting ear positioned at one end of one of the first housing and the second housing wherein said mounting ear includes a vertical portion, a horizontal portion and at least a locking portion extending from one end of the horizontal portion; wherein one of the first housing and the second housing further includes at least first slot for interferentially receiving the vertical portion, and at least a second slot for receiving the locking portion, and at least one engagement block is provided with the housing for engagement with an engaging tab extending from the locking portion of the mounting ear.

* * * * *